United States Patent [19]

Wuthrich

[11] 4,010,602

[45] Mar. 8, 1977

[54] HIGH FREQUENCY REED TIME GOVERNOR FOR A TIMEPIECE

[75] Inventor: Paul Wuthrich, Watertown, Conn.

[73] Assignee: Timex Corporation, Waterbury, Conn.

[22] Filed: June 9, 1975

[21] Appl. No.: 577,250

Related U.S. Application Data

[63] Continuation-in-part of Ser. No. 445,172, Feb. 25, 1974, abandoned.

[52] U.S. Cl. ..... 58/23 AC; 58/23 V

[51] Int. Cl.[2] ..... G04C 3/04

[58] Field of Search ..... 58/23 R, 23 V, 23 TF, 58/23 A, 23 AC, 28; 310/25, 26; 318/128, 129; 331/116 M

[56] References Cited

UNITED STATES PATENTS

| | | | |
|---|---|---|---|
| 3,207,965 | 9/1965 | Lavet | 58/23 TF |
| 3,591,814 | 7/1971 | Clifford | 58/23 TF |
| 3,594,621 | 7/1971 | Stechmann | 318/128 |
| 3,602,842 | 8/1971 | Smith | 58/23 V |
| 3,648,453 | 3/1972 | Aizawa | 58/23 V |
| 3,925,734 | 12/1975 | Smith | 331/116 M |

*Primary Examiner*—L. T. Hix
*Assistant Examiner*—Vit W. Miska

[57] ABSTRACT

A high frequency reed time governor for a timepiece comprises a high frequency reed made from a temperature stable material which oscillates above 1,000 Hz and a low frequency reed which oscillates below 500 Hz. A pair of magnets are coupled to each reed in a spaced relationship to interact with a common coil. The low frequency reed is coupled to the gear train of the timepiece through a click spring to provide a reliable mechanical pickup and it also oscillates as a motor in synchronism with the high frequency governed reed.

12 Claims, 6 Drawing Figures

HIGH FREQUENCY REED TIME GOVERNOR FOR A TIMEPIECE

BACKGROUND OF THE INVENTION

This application is a continuation-in-part of U.S. application Ser. No. 445,172, filed Feb. 25, 1974, now abandoned.

The present invention relates to timepieces and particularly to a high frequency reed time governor for watches.

Recent developments in the horological field include the commercialization of highly accurate quartz crystal watches wherein a high frequency quartz oscillator is used as a time base to synchronize a low frequency oscillator. Another design involves the use of a high frequency piezoelectric crystal oscillator whose frequency is reduced by a series of dividing circuits. The output of the dividing circuit is then used to drive the watch motor. While such quartz crystal type watches are highly accurate and have been increasing in popularity, they tend to be rather expensive.

Conventional mechanical and electronic watches including those of the tuning fork type do not have accuracies approaching that of the quartz type watches. Consequently, while such conventional watches may be somewhat less expensive than quartz watches at the present time, they are deficient in timekeeping characteristics.

Another problem encountered by electronic watches with mechanical oscillators is that of position error. The timekeeping of said watches depends to a certain extent upon the position of the watch relative to the earth's gravitational field. In highly accurate watches, the effect of position error must be drastically minimized. Other considerations which must be considered in the design of highly accurate watches include the durability and ruggedness of the movement and the power consumption of the electric circuit.

The prior art includes numerous quartz watch designs such as U.S. Pat. Nos. 3,668,860 to Diersbock which issued June 13, 1972 and Pat. 3,699,762 to Zatsky which issued Oct. 24, 1972. In the general area of vibrating reed governors, which encompasses the present invention, U.S. Pat. Nos. 3,192,701 to Tanaka issued July 6, 1965, 3,207,965 to Lavet issued Sept. 21, 1965 and 3,691,754 to Hetzel issued Sept. 19, 1972 were noted to be of interest. Lavet U.S. Pat. No. 3,207,965 discloses a mechanical oscillator arrangement including a pair of vibrating strips comprising a speed regulator and a synchronized servo-motor comprising a second pair of vibrating strips mounted in a common support and designed to operate a vibration-driven gear train. The structure of Lavet as well as the other above-mentioned prior art differs substantially from that proposed by the unique arrangement disclosed herein. These differences and the advantages of the present invention will become apparent in the description which follows.

SUMMARY OF THE INVENTION

The present invention pertains to an extremely accurate electronic or electrical watch including a high frequency reed time governor. The governing or synchronization means comprises a high frequency reed of a temperature stable material which oscillates above 1,000 Hz to eliminate position error due to gravity and a low frequency reed used as a vibrating motor which operates below 500 Hz to permit reliable mechanical pickup from the watch indexing means. Both the high and low frequency reeds are driven from the same coil which interacts with magnet pairs mounted on the respective reeds.

The high frequency reed is driven by pulses from the coil which is coupled to a conventional circuit such as that disclosed in Zemla U.S. Pat. No. 3,046,460. Feedback induced by this frequency stable reed synchronizes the drive pulses in a known manner. After a predetermined number of pulses, the current direction within the coil is reversed causing phase inversion of the drive pulses. This inversion completes a low frequency pulse envelope which interacts with the low frequency tuned reed. The low frequency reed is thereby maintained in oscillation as a motor synchronized by the high frequency governed reed.

Accordingly, an object of this invention is to provide a new and improved synchronized timepiece.

Another object of this invention is to provide a highly accurate watch including a high frequency reed time governor.

A further object of this invention is to provide a highly accurate inexpensive watch which includes a reliable mechanical pickup from a slave reed coupled to a stable high frequency time governing reed for synchronization purposes.

BRIEF DESCRIPTION OF THE DRAWINGS

Other objects and advantages of this invention may be more clearly seen when viewed in conjunction with the accompanying drawings. Similar reference numerals refer to similar parts throughout.

DETAILED DESCRIPTION OF THE INVENTION

Figure 1:
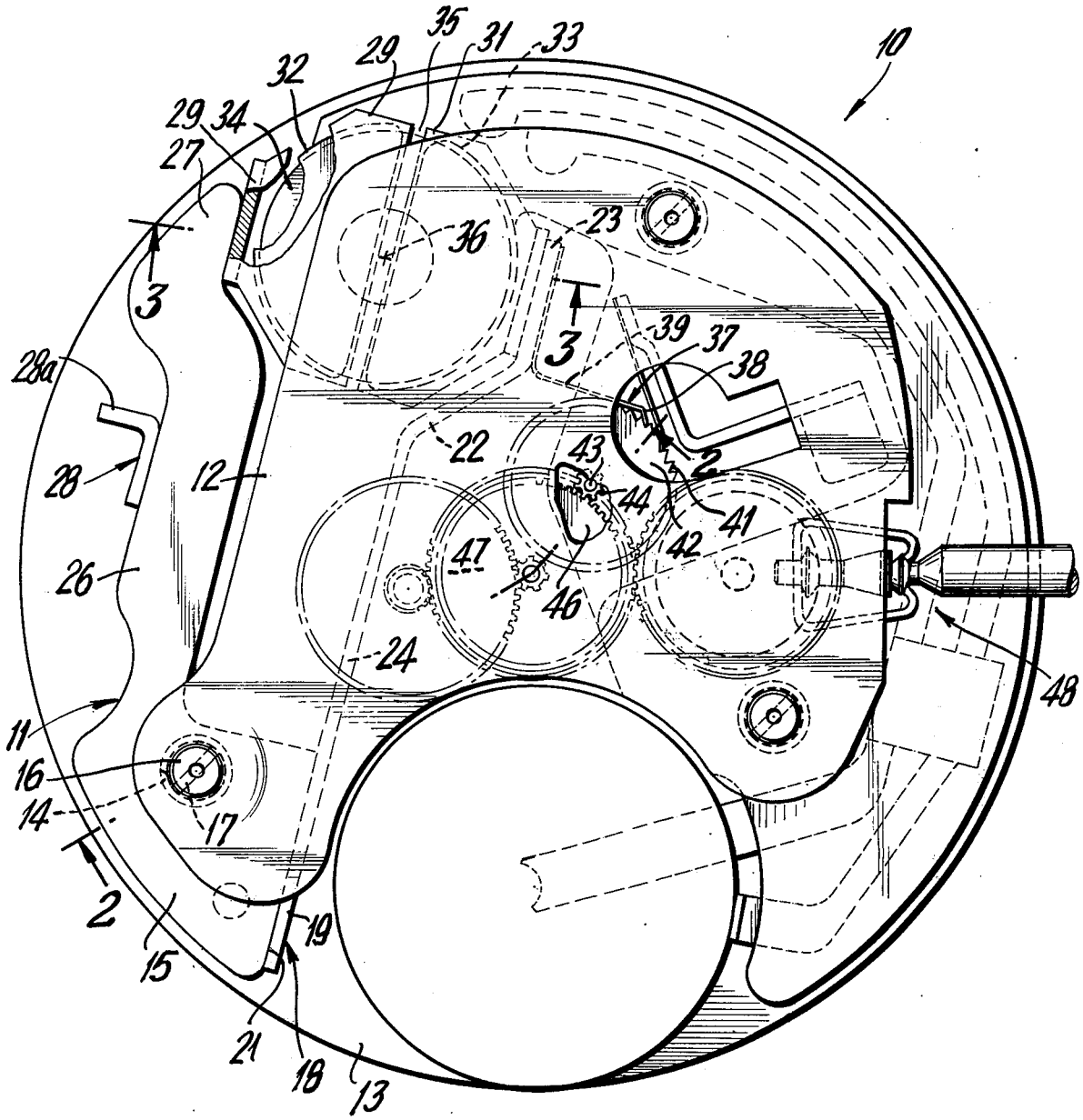
FIG. 1 is a plan view of the timepiece comprising the invention with portions shown in phantom and selected portions removed to illustrate the arrangement of parts.
Figure 2:
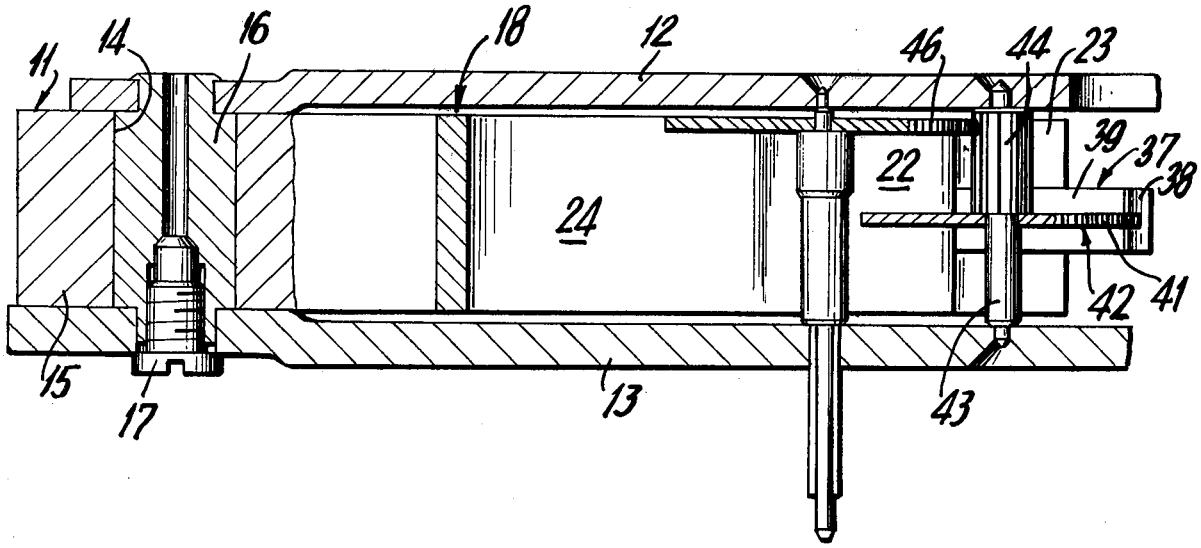
FIG. 2 is a cross-sectional side view taken along the line 2—2 of FIG. 1.

Referring now to the drawings, the invention comprises a timepiece 10 including a high frequency reed 11 which is mounted between plates 12 and 13. The reed 11 includes an aperture 14 which is engaged by an internally threaded sleeve 16. The sleeve 16 extends beyond the edges of the reed 11 and is used in combination with fastening means 17 to hold one end of the reed 11 in position between the plates 12 and 13.

The high frequency reed 11 is made from a temperature stable material such as Ni-Span-C and normally oscillates above 1,000 Hz to eliminate position error due to gravity. The reed 11 is of generally irregular configuration, with a fixed end portion 15, an elongated body portion 26 and a free end portion 27. The frequency of the reed 11 is adjustable by bending portion 28a of angle member 28.

The timepiece 10 also includes a low frequency reed 18 which is used as an oscillating motor and oscillates below 500 Hz. The reed 18 is thinner in cross-section than the high frequency reed 11. It is also mounted at one end 19 to the enlarged fixed portion 15 of the reed 11, extending along the surface 21 thereof to a formed portion 22 and then extending at its free end 23 in a plane substantially parallel to the main body portion 24.

Figure 3:
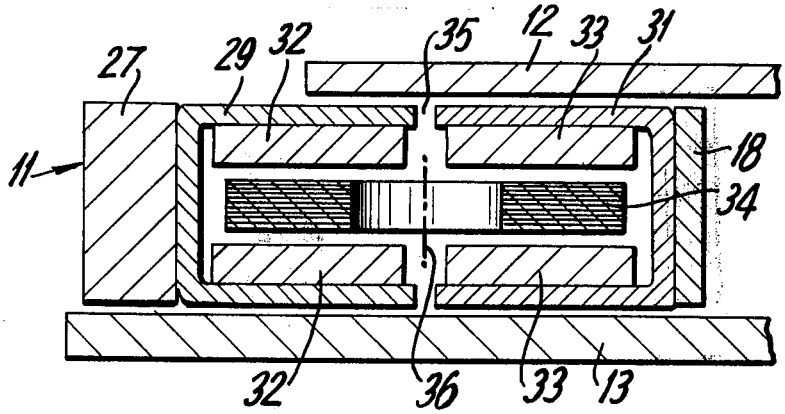
FIG. 3 is a cross-sectional side view taken along the line 3—3 of FIG. 1.

As may be seen from FIG. 3, the high frequency reed 11 includes a ferromagnetic channel member 29 mounted to the free end portion 27 thereof while the low frequency reed 18 similarly includes a ferromagnetic channel member 31 mounted thereto. The channel members 29 and 31 are spaced opposite each other with a predetermined gap 35 therebetween when the members 29 and 31 are at rest. Mounted to the internal leg portion of channel members 29 and 31 are magnet pairs 32 and 33 respectively. A coil 34 is centrally mounted between the magnet pairs 32 and 33 with its axis 36 extending in the gap 35 between the channel members 29 and 31.

The coil 34 is connected to the watch circuit (not shown) and is energized by current flow pulses first in one direction and then in the other direction after a predetermined interval. The energized coil 34 interacts magnetically with the magnet pairs 32 and 33 to drive the reeds 11 and 18 at their natural frequency as will be described later in greater detail.

A click spring 37 is mounted to the end portion 23 of the low frequency reed 18 and is oscillated thereby. The spring 37 includes a free end portion 38 formed at an angle to the main body portion 39 of the spring 37. The end portion 38 engages the teeth 41 of the index wheel 42 to provide a reliable mechhanical pickup from the reed 18. The index wheel 42 is mounted on a rotatable shaft 43 journaled between the plates 12 and 13. The shaft 43 also includes gear means 44 mounted on the upper portion thereof to engage the gear 46 driving the watch gear train 47 in a known manner. A stem arrangement 48 is also shown in FIG. 1 but is not described in detail since such arrangements are conventional with a typical design disclosed in U.S. Pat. No. 3,635,012 to R. J. Grohoski. Similarly, other portions of the watch 10, while appearing in the drawings, relate to conventional elements and are not necessary to an understanding of the invention. These portions, consequently, have not been mentioned in the specification.

Figure 4:
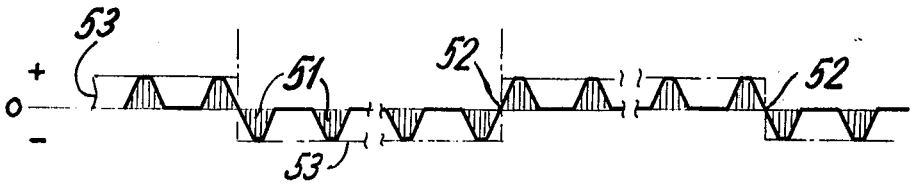
FIG. 4 is a wave diagram illustrating the synchronization of the drive pulses within a predetermined pulse envelope.

In a typical application, the high frequency reed 11 oscillates at 5,000 Hz and the low frequency reed 18 oscillates at 50 Hz. The high frequency reed 11 is driven by pulses 51 from the coil 34 as shown in FIG. 4. Feedback induced by this frequency stable reed 11, in turn, synchronizes the pulses 51 in a known manner. After a predetermined number of pulses, for example 50 drive pulses in the typical application cited above, phase inversion of the pulses 51 occurs at points 52. The phase inversion results from changing the direction of the current through the coil 34 by means of conventional circuitry. This inversion forms a low frequency pulse envelope 53 which interacts with the low frequency tuned reed 18 to maintain the reed 18 in oscillation as a motor in synchronism with the high frequency reed governor 11. The precise oscillations of the low frequency reed 18 are picked up by the click spring 37 and transmitted to the watch gear train 47 through indexing wheel 42. The combination of reliable mechanical pickup from the slave reed 18 at 50 Hz coupled to the 5,000 Hz stable high frequency time governing reed 11 permits an inexpensive wristwatch design with a timing accuracy equivalent to that of a quartz watch.

Figure 5:
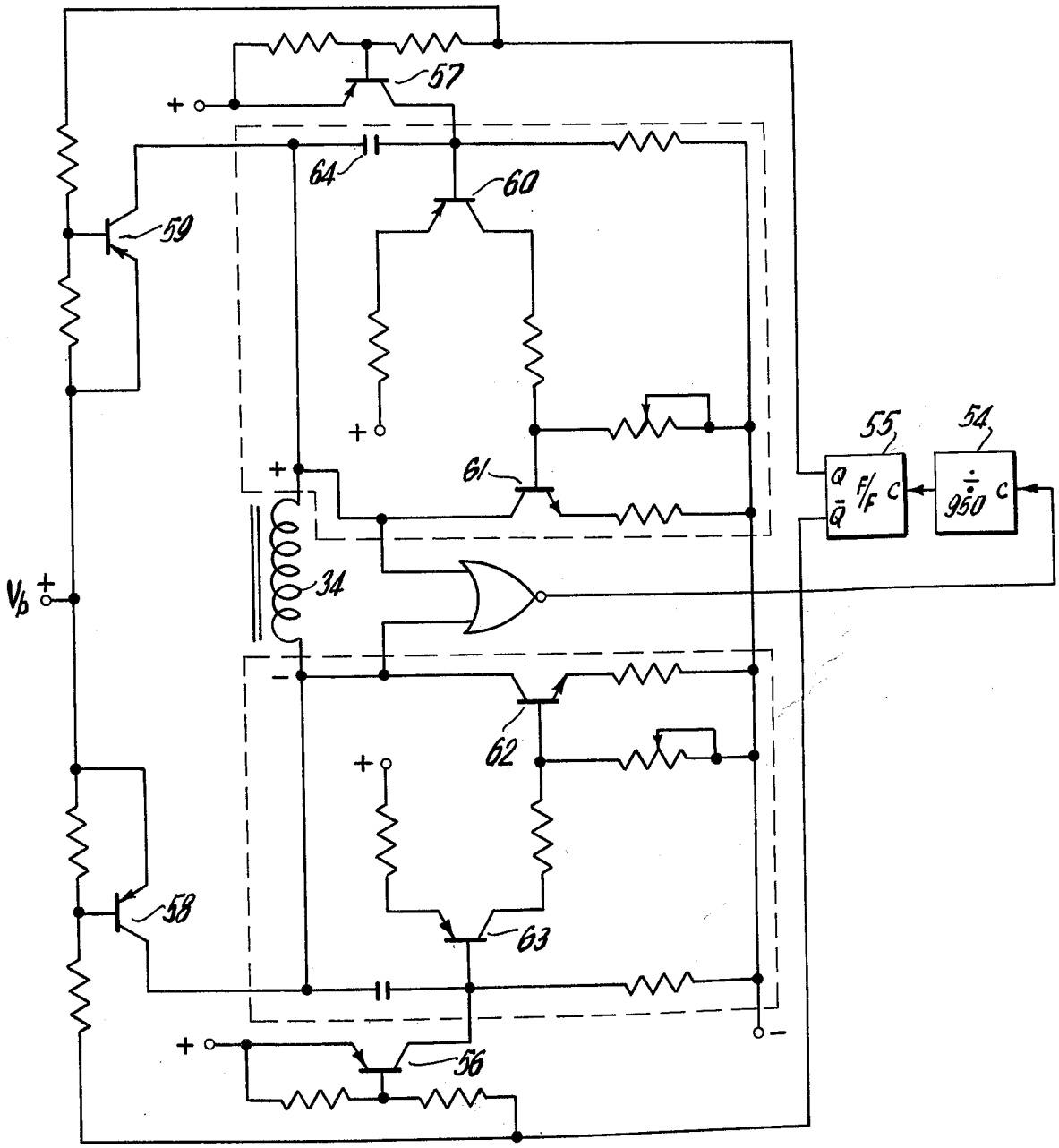
FIG. 5 is a schematic of an electric circuit for providing the current pulses shown in FIG. 4.

FIG. 5 is one embodiment of an electric circuit for providing current pulses 51 through coil 34 to, thereby, drive the high and low frequency reeds. This circuit causes the direction of the current pulses 51 through coil 34 to reverse 52 after a predetermined interval, for example, of fifty pulses. The current pulses are counted by a divide by fifty circuit 54, which triggers or causes the flip-flop 55 controlled devices 56, 57, 58 and 59 to reverse the direction of the current pulses through coil 34 after each count of fifty pulses. Each current pulse 51 occurs during a portion of each oscillation of the high frequency reed 11 and one hundred current pulses 51 correspond to each oscillation of the low frequency reed 18. The current pulses 51 are caused to reverse polarity at points 52 which occurs approximately at the point when the low frequency reed 18 is at its predetermined maximum amplitude swing on either side of the equilibrium point.

If we assume, for example, a start-up condition wherein the outputs Q and Q of flip-flop 55 are high and low respectively, then transistors 56, 58, 60 and 61 are biased or switched on, i.e. caused to conduct, and transistors 57, 59, 62 and 63 are turned or biased off. With transistors 58 and 61 switched on, a current pulse is provided through coil 34, via transistors 58 and 61, to drive or cause the high frequency reed 11 to oscillate from its equilibrium point to a predetermined amplitude. During this swing of the high frequency reed 11, transistors 60 and 61 are switched off by the charging of capacitor 64. The high frequency reed 11 then swings (back) past its point of equilibrium to its maximum amplitude on the other side of the equilibrium point. With another reversal of swing-direction of the reed 11, the reed magnet 32 crosses the coil 34 and, therefore, a voltage is induced across coil 34 which discharges capacitor 64 to switch or bias on transistor 60 which, in turn, switches on transistor 61 to cause another current pulse 51 to flow through coil 34. This cycle of events is repeated till a count of fifty current pulses is reached which causes the outputs Q and Q to flip-flop 55 to reverse to a low and high, respectively. With a low on output Q, transistors 57 and 59 are switched on and transistors 60 and 61 are switched off. With a high on output Q, transistors 56 and 58 are switched off and transistors 62 and 63 are switched on. In this manner, the current pulses 51 are provided in a manner similar to that described above, however, the direction or polarity of the current pulses 51 are reversed 52 by causing these pulses to flow through transistor 62, coil 34 and transistor 50 rather than, as above, through transistor 61, coil 34 and transistor 58.

It was also discovered that by proper selection of the circuit parameters, e.g. the bias level of transistors 60 and 62 and the inductance of coil 34, the amplitude and/or duration of the current pulses can be caused to vary selectively during each oscillation of the low frequency reed 18. In this manner the amount of drive energy introduced or provided to the low frequency reed 18 can be selectively varied during each osicillation of reed 18. For example, and with reference to FIGS. 5 and 6, a voltage is induced across coil 34 by the high frequency reed 11 magnet such that transistors 60, 61 or 62, 63 are switched on during at least a portion of each oscillation thereof. When the induced voltage is opposite in polarity to the battery voltage $V_b$, the effective voltage ($V_e$) is equal to the battery voltage ($V_b$) less the induced voltage ($V_i$), i.e., $V_e = V_b - V_i$. The induced voltage $V_i$ is equal to the sum of the voltages induced by the high and low frequency reeds, i.e. $V_i = V_1 + V_2$. The sum of induced voltages forms an envelope 65 which varies in accordance with the voltage waveform $V_2$ induced by the low frequency reed. The amplitude of the current pulse 51 through coil 34 can be determined as being equal to the effective voltage $V_e$ divided by the current path resistance which, for simplicity, can be represented by R. The current amplitude, therefore, will vary in a predetermined manner according to the equation I coil = $V_e$/R.

Figure 6:
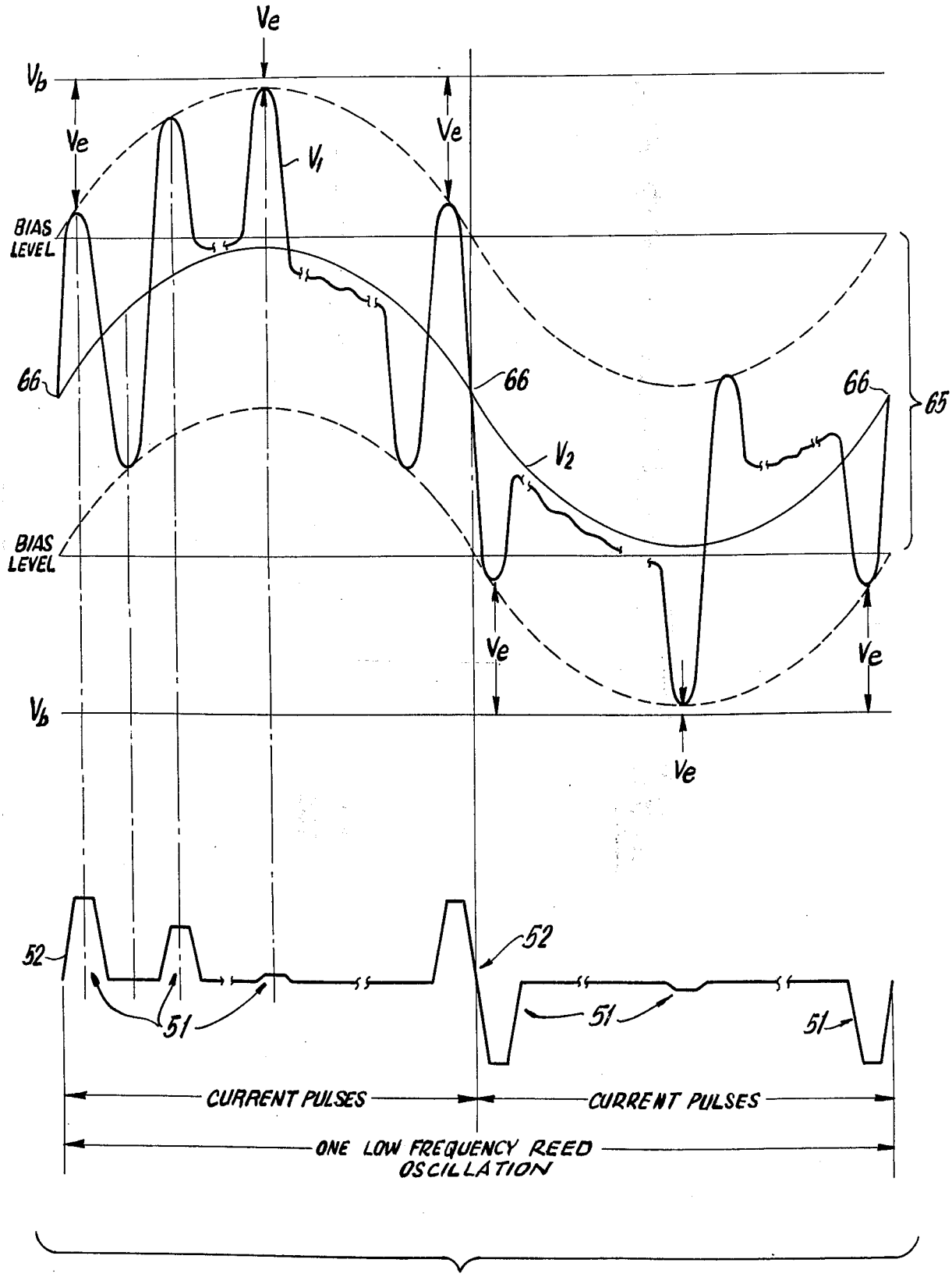
FIG. 6 is a sketch of the electrical potentials, waveforms and currents which result as the high and low frequency reeds oscillate.

In accordance with the embodiment of the invention shown in FIGS. 5 and 6, the effective voltage $V_e$ and, therefore, the magnitude of the current pulses through coil 34 are greatest or maximum approximately when the low frequency reed is at point 66 which corresponds to the time or point of oscillation when the low frequency reed is approximately at a maximum predetermined amplitude on either side of the equilibrium point. In this way, the frequency of the low frequency reed can be synchronized by the high frequency reed with conservation of current-energy since during this time of oscillation, i.e., when the low frequency reed is approximately at its maximum amplitude from equilibrium, it is most susceptable to frequency change from input of (drive) energy.

While the invention has been explained by a detailed description of certain specific embodiments, it is understood that various modifications and substitutions can be made in any of them within the scope of the appended claims which are intended also to include equivalents of such enbodiments.

What is claimed is:

1. In a timepiece having a gear train to drive the hands thereof, the combination comprising:

a high frequency reed fixedly mounted to the timepiece at one end and having a pair of spaced magnets mounted at the other end, a low frequency reed fixedly coupled to the timpiece at one end and having a pair of spaced magnets mounted at the other end, each of said spaced magnets being located opposite a corresponding magnet of the high frequency reed, a coil coupled to the timepiece and located symmetrically between the spaced magnets of the high frequency reed and the spaced magnets of the low frequency reed, means connecting the low frequency reed to the gear train for the timepiece, and drive means for activating the coil with current pulses which reverse polarity after a predetermined number of said current pulses and substantially at a point when the low frequency reed is at a predetermined maximum amplitude swing to interact with the pairs of spaced magnets thereby maintaining said low frequency reed in oscillation synchronized by said high frequency reed.

2. A timepiece according to claim 1 wherein:

the means connecting the low frequency reed to the gear train comprises a click spring mounted to said reed and designed to engage the gear train of the timepiece.

3. A timepiece according to claim 1 wherein:

the drive means causes the current pulses to alternate in opposite direction at a predetermined point of oscillation of the low frequency reed.

4. A timepiece according to claim 1 wherein:

the drive means causes the amplitude of the current pulses activating the coil to vary at predetermined levels at predetermined points of each oscillation of the low frequency reed.

5. A timepiece according to claim 2 wherein:

the high frequency reed comprises a temperature stable material of a predetermined configuration which oscillates above 1,000 Hz, and the low frequency reed comprises a reed of a predetermined configuration oscillating below 500 Hz.

6. A timepiece according to claim 2 wherein:

the high frequency reed and the low frequency reed each include a channel member mounted thereto and having one of said spaced magnets in each pair mounted on opposite legs of the channel member.

7. A timepiece according to claim 2 wherein:

the low frequency reed is fixedly mounted to the fixed end of the high frequency reed.

8. A timepiece having a gear train to drive the hands thereof comprising:

a high frequency reed having a pair of space magnets mounted thereto, a low frequency reed having a pair of spaced magnets mounted thereto, said spaced magnets being located opposite corresponding magnets of the high frequency reed, coil means mounted in the gap between the pairs of spaced magnets, means connecting the low frequency reed to the gear train of the timepiece to provide a reliable mechanical pickup, and drive means for activating the coil with current pulses which reverse polarity at a predetermined number of said current pulses and substantially at a point when the low frequency reed is at a predetermined maximum amplitude swing to provide a low frequency pulse envelope having pulses which interact with the low frequency reed maintaining said reed in oscillation synchronized by the high frequency reed.

9. A timepiece including gear means coupled to the hands thereof comprising:

a drive circuit, a coil coupled to said drive circuit, a high frequency reed having one end fixedly mounted within the timepiece and having a free end including magnet means mounted thereto, adjacent said coil, a low frequency reed having one end fixedly mounted within the timepiece and a free end having magnet means mounted thereto, said free end being positioned adjacent said coil and opposite the corresponding free end of the high frequency reed, means coupling the low frequency reed to the gear means, and wherein the high frequency reed is driven by pulses induced from the coil, said pulses being caused to reverse polarity after a predetermined number of said current pulses and substantially at a point when the low frequency reed is at a predetermined maximum amplitude swing to synchronize said low frequency reed, said low frequency reed driving the gear means to provide highly accurate timekeeping.

10. A timepiece according to claim 9 wherein:

the magnet means mounted to the high frequency reed and the magnet means mounted to the low frequency means each comprise a pair of spaced magnets with corresponding magnets on each reed spaced opposite one another with a predetermined gap therebetween, and the coil is symmetrically mounted in a plane between the pairs of magnets.

11. A timepiece in accordance with claim 10 wherein:

the high frequency reed is a predetermined irregular configuration, and the timepiece further includes means for limiting the oscillations of the high frequency reed.

12. A timepiece in accordance with claim 11 wherein:

the high frequency reed is designed to oscillate above 1,000 Hz, and the low frequency reed is designed to oscillate below 500 Hz.

* * * * *